US008061110B2

(12) United States Patent
Wetsch

(10) Patent No.: US 8,061,110 B2
(45) Date of Patent: Nov. 22, 2011

(54) INFLATION AND SEALING DEVICE WITH DISENGAGEMENT MECHANISM

(75) Inventor: Thomas D. Wetsch, St. Charles, IL (US)

(73) Assignee: Pregis Innovative Packaging, Inc., Deerfield, IL (US)

( * ) Notice: Subject to any disclaimer, the term of this patent is extended or adjusted under 35 U.S.C. 154(b) by 225 days.

(21) Appl. No.: 12/249,673

(22) Filed: Oct. 10, 2008

(65) Prior Publication Data

US 2009/0094939 A1 Apr. 16, 2009

Related U.S. Application Data

(60) Provisional application No. 60/979,640, filed on Oct. 12, 2007.

(51) Int. Cl.
*B65B 31/00* (2006.01)

(52) U.S. Cl. ..... 53/79; 53/403; 53/477; 53/469; 53/512

(58) Field of Classification Search ..... 53/403, 53/477, 79, 469, 512
See application file for complete search history.

(56) References Cited

U.S. PATENT DOCUMENTS

| | | | | |
|---|---|---|---|---|
| 2,392,695 | A * | 1/1946 | Rohdin | 156/289 |
| 3,149,560 | A * | 9/1964 | Finke | 100/342 |
| 4,017,351 | A | 4/1977 | Larson et al. | |
| 4,172,750 | A * | 10/1979 | Giulie | 156/267 |
| 5,048,269 | A * | 9/1991 | Deni | 53/512 |
| 5,417,041 | A * | 5/1995 | Hansen et al. | 53/550 |
| 5,537,804 | A * | 7/1996 | Tolson | 53/479 |
| 6,209,286 | B1 | 4/2001 | Perkins et al. | |
| 6,605,169 | B2 | 8/2003 | Perkins et al. | |
| 6,656,946 | B2 | 12/2003 | Himmelsbach et al. | |
| 6,698,041 | B2 * | 3/2004 | VanSteenburg et al. | 5/81.1 R |
| 6,786,022 | B2 | 9/2004 | Fuss et al. | |
| 6,932,134 | B2 | 8/2005 | Selle et al. | |
| 7,040,073 | B2 | 5/2006 | Perkins et al. | |
| 7,325,377 | B2 | 2/2008 | Fuss et al. | |
| 7,526,904 | B2 * | 5/2009 | Fuss et al. | 53/403 |
| 7,578,333 | B2 * | 8/2009 | Greenwood et al. | 156/498 |
| 2002/0108352 | A1 | 8/2002 | Sperry et al. | |
| 2004/0206050 | A1 | 10/2004 | Fuss et al. | |
| 2006/0010835 | A1 * | 1/2006 | Shaw et al. | 53/403 |
| 2006/0090421 | A1 | 5/2006 | Sperry | |

(Continued)

FOREIGN PATENT DOCUMENTS

| | | |
|---|---|---|
| EP | 1 280 651 | 2/2010 |
| WO | WO2002/014156 | 2/2002 |

OTHER PUBLICATIONS

"Pregis Safety, Operation, and Maintenance Pregis AIRSPEED 5000 Air Cushion Machine Manual version 3", 2007.

(Continued)

*Primary Examiner* — Hemant M Desai
(74) *Attorney, Agent, or Firm* — Dorsey & Whitney LLP

(57) ABSTRACT

A device for inflating and sealing an inflatable structure, such as inflatable cushions is disclosed. The device includes an inflation assembly configured for inflating a cushion cavity of a film material with a fluid such as air and a sealing assembly comprising first and second assembly portions configured for receiving and sealing overlapping portions of the film. A disengagement mechanism is associated with the first and second assembly portions for moving the first assembly portion relative to the second assembly portion for reversibly disengaging the portions for releasing the pressure therebetween.

31 Claims, 9 Drawing Sheets

U.S. PATENT DOCUMENTS

| | | | | |
|---|---|---|---|---|
| 2006/0292320 | A1 | 12/2006 | Greenwood et al. | |
| 2007/0251190 | A1 * | 11/2007 | Daigle et al. | 53/403 |
| 2009/0049803 | A1 * | 2/2009 | Limousin | 53/476 |
| 2010/0051202 | A1 * | 3/2010 | Greenwood et al. | 156/538 |

OTHER PUBLICATIONS

International Search Report for the International Application No. PCT/US2008/079583.

* cited by examiner

INFLATION AND SEALING DEVICE WITH DISENGAGEMENT MECHANISM

CROSS-REFERENCE TO RELATED APPLICATION(S)

The present invention relates to U.S. provisional Application No. 60/979,640 filed Oct. 12, 2007, the entire disclosure of which is incorporated herein by reference.

FIELD OF THE INVENTION

The invention relates to the manufacturing of packaging materials, and more particularly to a device for inflating and sealing inflatable air cushions that are used as packaging materials.

BACKGROUND OF THE PRESENT INVENTION

Devices are known for inflating flexible structures, such as inflatable air cushions or pillows (hereinafter referred to as "cushions") that are used to provide added protection to an object during packaging and transportation of fragile articles. One example of an inflation and sealing device is disclosed in U.S. Pat. No. 6,209,286. The device uses drive rollers, in combination with idler rollers located underneath the drive rollers, to advance preformed sheet material. A second set of drive rollers and a belt assembly is provided downstream of a seal forming apparatus to keep the material taut and to pull the material through the seal forming apparatus. U.S. Pat. No. 6,932,134 discloses a device having an inflation nozzle with two inflation outlets, for inserting gas longitudinally and laterally into the web of material; a feeding area including top and bottom drive belts and insertion idle rollers that guide the drive belts; and a sealing clamp parallel to the sealing element. U.S. Publication No. US 2006/0292320 discloses a device having an air barrier including two tracked bets; top and bottom heat sealers, each including two belts, with each belt arranged around four end rollers, including a drive end roller, a tensioner end roller, and two idler end rollers.

It would be advantageous to provide a simplified inflation and sealing device with improved ease of operation and maintenance.

SUMMARY OF THE INVENTION

The invention is directed to a device for inflating and sealing an inflatable, flexible structure, such as air cushions. The preferred embodiment comprises an inflation assembly and a sealing assembly. The inflation assembly is configured for inflating a cushion cavity disposed between first and second layers of a film with a fluid. The inflation assembly can comprise a fluid conduit configured for longitudinal reception between overlapping portions in the inflation channel and a cutter, e.g., a blade, disposed proximate the fluid conduit and configured and oriented to cut open the inflation channel to provide an exit from the channel for the conduit.

The sealing assembly comprises first and second assembly portions configured for receiving overlapping portions of the first and second film layers adjacent the inflated cavity, cooperatively driving the overlapping portions along a sealing direction, and applying sufficient pressure to the overlapping portions to substantially keep the fluid from escaping from between the overlapping portions and to seal the overlapping portions to each other and to from a longitudinal seal configured to seal the fluid in the cushion cavity. In an embodiment, the first assembly portion comprises a plurality of rollers and a belt supported and driven therearound for driving the overlapping portions in the sealing direction, and the second portion comprises a support surface facing the belt, which can be substantially stationary. A transmission can operably associate a motor with the first assembly portion for driving the belt. The belt can be configured to move at a different speed from the support surface to cause the overlapping portions to slide against the support surface while driving the overlapping portions along a sealing direction. The sealing assembly also comprises a heater associated with the belt for transferring heat through the belt for heating and sealing the overlapping portions. At least a portion of the belt and the support surface can comprise a heat-resistant material having a melting temperature greater than 200° F., such as a fluorocarbon or a silicon composite.

The device also includes a disengagement mechanism associated with the first and second assembly portions for moving, e.g., linearly, the first assembly portion relative to the second assembly portion for reversibly disengaging the first and second assembly portions for releasing the pressure therebetween. In an embodiment, the disengagement mechanism is configured for separating the first and second assembly portions to release the overlapping portions from therebetween. A handle is mounted pivotally with respect to at least one of the assembly portions and operably associated with the disengagement mechanism for engaging and disengaging the assembly portions. The handle is pivotably associated with the disengagement mechanism for pivoting about an axis that is generally aligned with the sealing direction. The handle extends over the first portion in the engaged position, and is pivoted away from the engaged position in the disengaged position.

The disengagement mechanism can be configured so remain stably in an engaged position in which the first and second portions apply pressure against each other. For example, the disengagement mechanism can comprise a four-bar linkage with a handle that is rotatable to move the first or second portion and that has an over center position to stably remain in the engaged position.

BRIEF DESCRIPTION OF THE DRAWINGS

The above features and other advantages of the invention will become better understood by reference to the following detailed description of preferred embodiments and the accompanying drawings wherein.

DETAILED DESCRIPTION OF THE PREFERRED EMBODIMENTS

According to an embodiment, the device can be used with suitable uninflated film structures or materials to form a variety of suitable inflatable structures or cushions, such as inflatable cushions with longitudinal axes that can be, for instance, oriented longitudinally, transversely, or in any other pattern with respect to the longitudinal axis of the film. Examples of such film structures are disclosed in U.S. application Ser. No. 11/123,090, the entire content of which is expressly incorporated herein.

Figure 1:
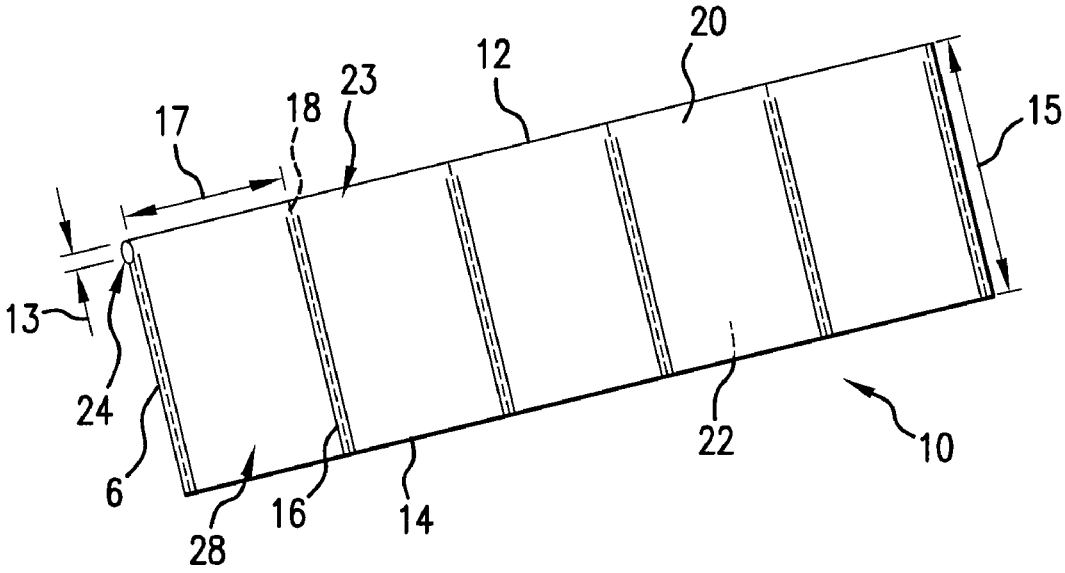
FIG. 1 is a perspective view of an embodiment of a film of uninflated cushions that can be inflated and sealed by a device constructed according to the invention.
Figure 2:
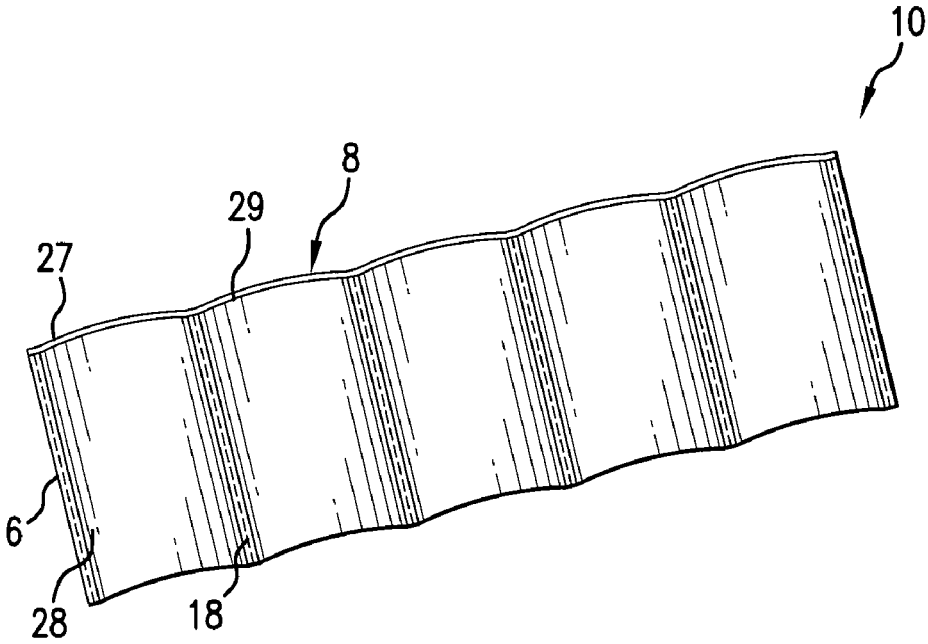
FIG. 2 is a perspective view of thereof after inflation and sealing by the device.

Referring to FIG. 1, an example of an inflated film material 10 that can be used with the device to make inflatable cushions is shown. Upon inflation, the film 10 forms a series of transversely-oriented cushions attached at perforated edges, as shown in FIG. 2. The film 10 can be made of any of a variety of different materials. Suitable materials include polyolefin materials, including polyethylenic resins such as low density polyethylene (LDPE), linear low density polyethylene (LLDPE), and high density polyethylene (HDPE); metallocenes; and ethylene vinyl acetates (EVA); and blends thereof. Other materials such as paper-based films and paper films having a thin polyethylene coating can also be used.

The film 10 has a first longitudinal edge 12 and a second longitudinal edge 14, both of which are preferably closed or joined. The film 10 has a lead end 6, and also includes generally transverse seals 16, which each include a line of weakness 18, such as perforations or a score line. The transverse seals 16 join a first film layer 20, such as a top layer, of the film 10 to a second film layer 22, such as a bottom layer, of the film 10 along the seals, and, together with the closed, second longitudinal edge 14, define an inflation cavity of each cushion 28. The first and second film layers 20,22 define a major surface or plane of the film 10. The transverse perforations 18 perforate the film 10 through the first and second film layers 20,22 to facilitate separation of each cushion 28 from each other. Other embodiments can have an inflation channel remote from the edge, such as in the center, for example to form inflated chambers on opposite sides of the inflation channel.

In an embodiment, the first and second film layers 20,22 are attached to each other along the second longitudinal edge 14, but are unattached to each other along the first longitudinal edge 12 prior to inflation. Such a configuration can be formed from a single layer of film material, a flattened tube of film material with one edge slit open, or two separate layers of film material. For example, the first and second film layers 20,22 can include a single sheet of film material that is folded over itself to define the attached second longitudinal edge 14 (i.e., "c-fold film").

The film 10 has a width 15, and a perforation-to-perforation length 17, which may be selected depending on the particular type of cushion being manufactured. Preferably, the width 15 of the film 10 is at least about 6 inches and at most about 36 inches, more preferably is at least about 12 inches and at most about 24 inches, although other widths can be used. In a preferred embodiment, the width 15 is about 18 inches. The perforation-to-perforation length 17 is preferably at least about 4 inches and at most about 24 inches, and is more preferably at least about 8 inches and at most about 12 inches, although other lengths can be used.

In the embodiment shown in FIG. 1, the transverse seals 16 begin at the second longitudinal edge 14 of the film 10, and extend transversely up to a distance 13 from the first longitudinal edge 12. The distance 13 is preferably at least about 0.25 inches and at most 1 inches, and more preferably at least about 0.3 inches and at most about 0.7 inches, but greater or smaller distances can be used in different embodiments. In a preferred embodiment, the distance 13 is from about 0.5 to about 0.6 inches.

Because the transverse seals 16 do not extend all the way to the first longitudinal edge 12 of the film 10, an opening 24 is defined between each end of a transverse seal 16 and the first longitudinal edge 12 of the film 10. The area of the film 10 between the opening 24 and the overlapping film layers adjacent the first longitudinal edge 12 defines a continuous, longitudinal inflation channel 23 having a width defined by the distance 13. The lead opening 24, i.e., the opening at the lead end 6, is generally used to feed the inflation channel 23 of the film 10 over an inflation nozzle of an inflation device when loading the film to the device. The width of the inflation channel 23 is preferably configured to produce a tight, or in some embodiments a friction-fitting association, over the inflation nozzle to prevent or substantially reduce air leakage during inflation. Advantageously, this reduces the amount of compressed air required for inflation, and minimizes the size of the compressor and power utility requirements of the inflation device.

In FIG. 2, each inflated cushion 28 is separated from a neighboring inflated cushion by a transverse line of weakness 18. As a remnant of the manufacturing process explained below, small cutaway flaps 27 are left on the inflated film 10 adjacent to the first longitudinal edge 12. The manufacturing process also forms a longitudinal seal 29 along a sealing or overlapping portion 8 of the inflated film 10 (defined by the overlapping edge portions of the film layers 20,22), so that each inflated cushion 28 is sealed closed, trapping the inflation fluid, which is preferably a gas and more preferably air, within the cushion. The longitudinal seal 29 is preferably substantially straight, but in other embodiments, the seal can have a curved, zig-zag, or other configurations.

Figure 3:
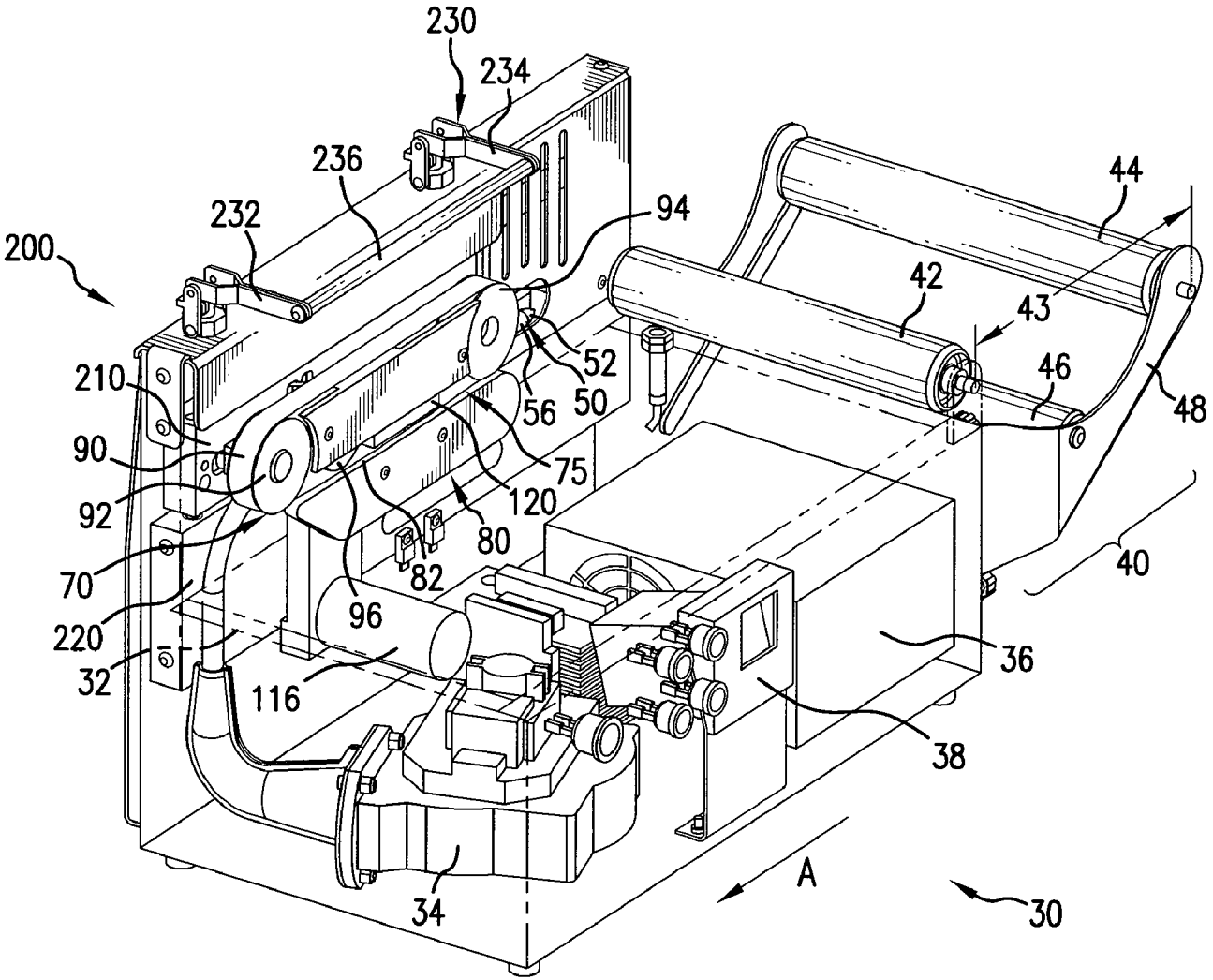
FIGS. 3-5 are front perspective, side, and rear perspective views, respectively, of an embodiment of a device constructed according to the invention.
Figure 4:
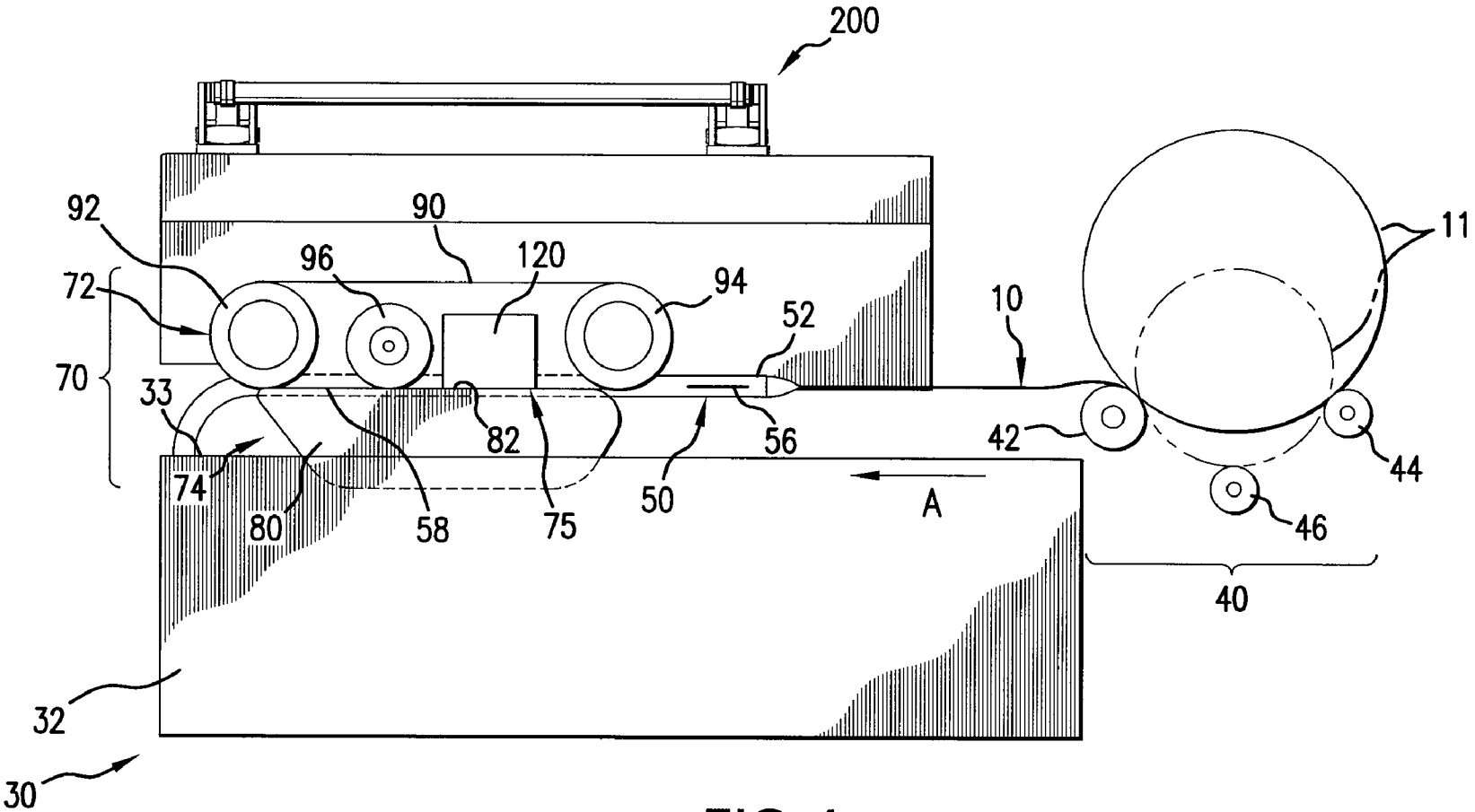

Referring to the embodiments shown in FIGS. 3 and 4, the device 30 includes a film support assembly 40, an inflation assembly 50 connected to an air pump 34, a sealing assembly 70, and a power supply 36. The mechanisms can be partially or entirely covered by a housing 32. The device 30 can also include a control panel 38 for monitoring and/or controlling the operation of the device 30. While the device 30 will now be described with respect to inflation of the preferred film embodiment shown in FIG. 1, it will be appreciated that the device 30 can be used to inflate a variety of film structures having different configurations.

The film support assembly 40 is preferably configured for supporting a bulk supply of film of uninflated cushions, such as a roll 11 shown in FIG. 4. Preferably, the support assembly 40 can accommodate rolls of film 11 that are at least about 5 inches in diameter. In a preferred example, the roll 11 has a diameter of about 5 to 15 inches, more preferably about 10 inches. In other embodiments, the support assembly 40 can accommodate a roll of film with other dimensions, or a supply of film that is provided in other bulk forms, for example as a continuous stack of film material.

The support assembly 40 preferably can support a weight of at least about 5 lbs, preferably at least about 10 lbs, and more preferably at least about 15 lbs, although typically no more than about 30 lbs is necessary to be supported. In an example, the roll of film 11 has a weight of about 20 to 30 lbs. In other embodiments, the support assembly 40 can accommodate other weights.

The support assembly 40 preferably includes a cradle that is formed by a pair of support members spaced apart from each other, such as support rollers 42,44, extending transversely with respect to the inflation and sealing assemblies 50,70. In this configuration, the support rollers 42,44 cooperatively support a roll of film therebetween, along an outer circumference of the roll. Preferably, the support rollers 42,44 are free-standing, undriven rollers, which are not coupled to each other or to any driving mechanism. The distance 43 between the support rollers 42,44 can be adjustable or selected as desired, depending on the diameter of the roll of film that is to be supported therebetween. In the embodiment shown in FIG. 3, one support roller 42 is placed proximate an edge of the housing 32, closer to the sealing mechanism, while the other support roller 44 is placed on an arm 48 that extends from the housing 32, farther from the sealing mechanism. The distance 43 can be adjusted by changing the length of the arm 48, or by using an arm that is movable with respect to the housing 32, although the support rollers, although the support rollers 42,44 are fixed in the preferred embodiment.

This cradle arrangement is advantageous in that a film supply roll can be placed thereon with minimal effort. Merely requiring the roll to be placed on top of the two rollers 42,44 in the cradle minimizes the need to maneuver to properly load the roll for inflation and sealing operation.

In a preferred embodiment, the support assembly 40 includes a third support member, such as a third roller 46. The third roller 46 is disposed between and beneath the support rollers 42,44, and extends transversely with respect to the inflation and sealing assemblies 50,70. In the embodiment shown in FIG. 3, the third roller 46 is placed on a second portion of the arm 48, between and beneath the support rollers 42,44. The third roller 46 supports the roll of film 11 when the material remaining on the roll has a diameter sufficiently small to fall between the two first rollers 42,44.

The film 10 is pulled from the roll 11, preferably by the sealing mechanism 70, in the downstream direction A during the inflation and sealing operation. The major surface of the film 10 preferably extends substantially along and transversely to the direction A.

The inflation assembly 50 is preferably mounted to the housing 32 and positioned proximate the sealing assembly 70. The inflation assembly 50 is positioned within the device 30 such that it is generally aligned with first longitudinal edge 12 and the inflation channel 23 as the film 10 is directed through the device 30. The inflation assembly 50 is configured and oriented for inflating cushion cavities 28 of the film 10 with a fluid, which is preferably a gas, and more preferably air.

The inflation assembly 50 preferably includes a fluid conduit or nozzle 52. The nozzle 52 is connected to a fluid or gas supply, such as air pump 34. The nozzle 52 is preferably tubular and extends in a longitudinal direction that is generally parallel to the downstream direction A of the moving film 10. The nozzle 52 is secured to the device by any suitable means, such as fasteners.

In an example, the device contains a supply of the fluid or gas, such as an air or gas pump 34, an air accumulator, or an air compressor or other similar compressed fluid, gas, or air source, which is connected to the nozzle 52 for delivering inflation fluid therethrough. Alternatively, the inflation fluid is provided from an external source, such as an external air compressor connected to the nozzle. A pressure regulator, a pressure gauge, or such other device can be connected to the fluid supply to monitor and regulate the fluid pressure.

The nozzle 52 is preferably aligned with the inflation channel 23 of the film 10. Preferably, the nozzle 52 has an outer diameter 53 that is configured for a tight, and more preferably friction-fitting, receipt within the inflation channel 23, although a looser fit can be employed in alternative embodiments, allowing some air to escape around the nozzle. The outer diameter 53 is at least about 0.15 inches and at most about 0.75 inches in an embodiment, and preferably is at least about 0.25 inches and at most about 0.5 inches. In a preferred example, the outer diameter 53 is about 0.3 inches, but can have other dimensions in other embodiments. In other embodiments, the nozzle is removable such that nozzles of different sizes and configurations can be used, depending on the configuration of the cushion and inflation channel of the film to be inflated.

In a preferred example, the tip 54 of the nozzle has a tapered configuration, although in other embodiments, the nozzle tip can have other configurations. The tip 54 is preferably smooth and rounded. As shown in FIGS. 3 and 4, the tip 54 is preferably positioned just upstream from the sealing assembly 70, although other suitable positions can alternatively be employed.

The nozzle 52 includes an outlet from which inflation fluid is expelled to inflate the cushion cavities of the film 10. The outlet is preferably disposed near the nozzle tip 54, but can alternatively or additionally be placed in different suitable locations. In an embodiment, the outlet is a lateral slot 56 that extends along a portion of the longitudinal length of the nozzle 52 and is positioned to direct air substantially transversely into the cushion cavities. The lateral outlet 56 can have any suitable length. In an example, the outlet 56 has a length that is longer than the perforation-to-perforation length 18 of the film 10 to maximize the inflation efficiency of the air expelled from the outlet 56 and into the cushion cavities. Preferably, the cushions 28 are filled with air at an inflation pressure of at least about 3 psi, and more preferably at an inflation pressure of at least about 5 psi, and up to about 15 psi. In an example, the inflation pressure of the cushions 28 is between about 5 psi and about 8 psi, but other inflation pressures can be used as desired.

The nozzle 52 can include more than one outlet. In an example, a pair of outlets is disposed diametrically opposite each other on the circumference of the nozzle. In another example, the nozzle includes three or more outlets disposed around the circumference of the nozzle.

Figure 9:
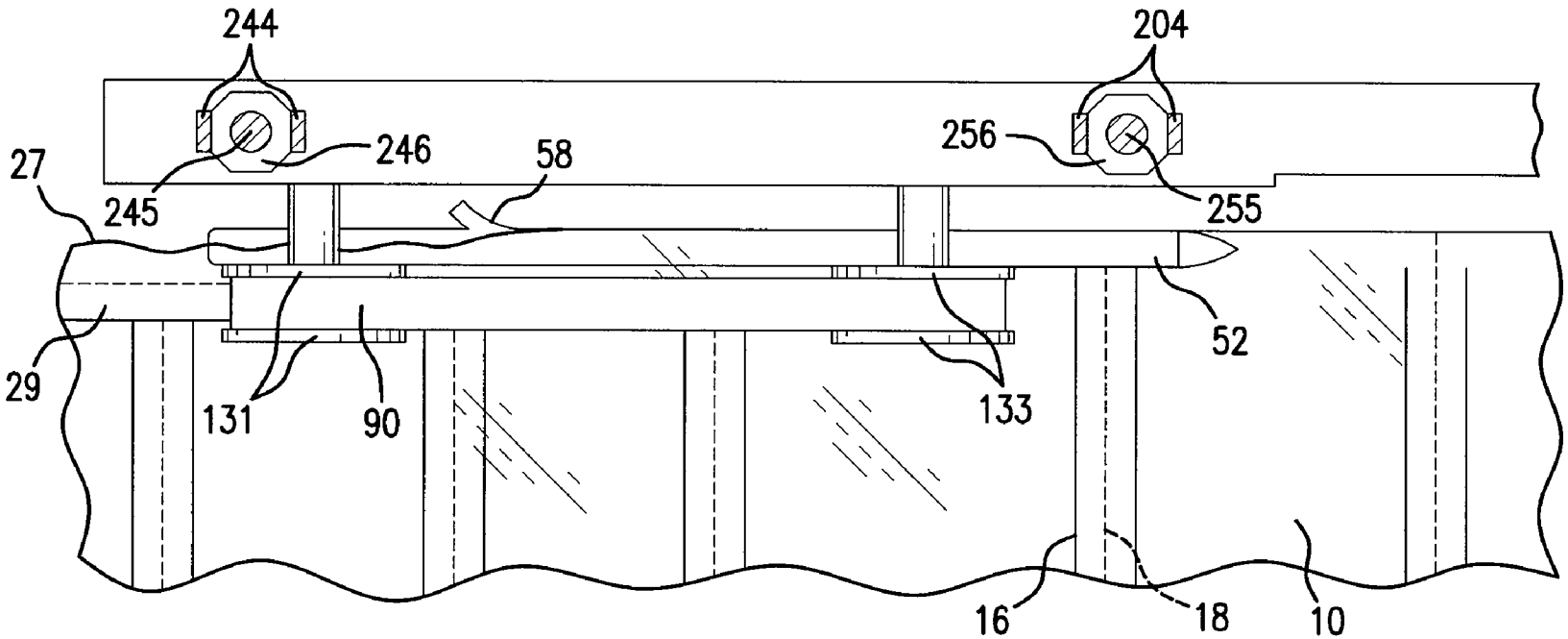
FIG. 9 is a top view of a portion of the inflation and sealing assemblies of another embodiment of the invention.

The preferred inflation assembly 50 also includes a cutting element, which is preferably a blade 58. The blade 58 is preferably disposed and secured within a blade slot defined in the tubular wall of the nozzle 52. The nozzle is preferably made of steel with a wall thickness that is at least about 0.01 inches and at most about 0.07 inches, and is more preferably about 0.03 inches. The blade slot is machined within the tubular wall preferably avoiding or minimizing any leaks from the nozzle 52. Preferably, the blade 58 is disposed about the nozzle 52 on the opposite side from the inflation outlet 56. The blade 58 is positioned along the nozzle 52 downstream from the outlet 56, and adjacent the sealing assembly 70, as shown in FIGS. 4 and 9. The blade 58 is made of any material suitable for cutting, such as metal. At least an edge portion of the blade 58 can be coated to increase the cutting ability and wear resistance, for example with titanium nitride.

The blade 58 is preferably configured to cut the film 10 after inflation of the cushions 28 to allow the film to release the nozzle. More preferably, the blade 58 cuts a portion of the first or second film layers 20,22 near or adjacent to the first longitudinal edge 12 of the film 10 (i.e., at or adjacent to the sealing or overlapping portion 8), as the film 10 is directed in the downstream direction A, or near the inflation nozzle if located in a portion other than the edge. By cutting a portion of the film 10, the inflation assembly 50 is released from association with the inflation channel 23 of the inflated film 10 (i.e., between the film layers 20,22).

The sealing assembly 70 is positioned within the device 30 downstream from the inflation outlet 56 of the inflation assembly 50 so that the cushions 28 of the film 10 are sealed after being inflated. The sealing assembly 70 includes a first assembly portion 72 and a second assembly portion 74, between which the film 10 is disposed. The preferred first and second portions 72,74 are arranged such that the nozzle 52 is disposed vertically therebetween and horizontally and laterally beyond the sealing portions 72,74 opposite from the inflation cavity, as shown in FIG. 4. Preferably, the first portion 72 includes a belt 90 arranged around belt supports, such as two end rollers 92,94, a heating/sealing element 120, and optionally one or more pressure rollers 96 to press the belt 90 against the film 10 to press the film 10 against the second portion 74. The second portion 74 includes a support surface 75, and can additionally include a heating/sealing element and/or one or more pressure rollers. The arrangement of elements of the sealing assembly 70 is configured allow the film 10 to slide over the support surface 75 in the direction A, with the pressure roller 96 or another of the rollers or a suitable driving mechanism guiding the film 10 in that direction. The contact pressure between the film 10 and the belt 90 and the support surface 75 is light, such that there is sufficient drag force on the film 10 to continue advancing it through the device 30 but not to cause the film 10 to separate along the perforations 18.

The path traveled by the film is preferably substantially linear and preferably level throughout the inflation and sealing process, but can alternatively be curved. Thus, the sealing assembly 70 is preferably substantially aligned with the inflation assembly 50. Preferably, the sealing assembly 70 is configured for forming a substantially longitudinal seal 29 between the film layers 20,22. The heating element 120 is arranged to contact the belt 90 and hold or press it against the overlapping portion 8, which includes or is adjacent to the inflation channel 23 and preferably near the first longitudinal edge 12, as the film 10 slides in the direction A. In other embodiments, the sealing assembly can be configured for forming a seal that has a curved, zig-zag, or other configuration.

The belt 90 is driven in the direction A to direct the film 10 in the downstream direction A when the film 10 is placed under the belt 90. The belt can be driven by either of the end rollers 92,94, with the other end roller being free-rolling. Alternatively, the belt can be driven by a separate roller, such as pressure roller 96, that is located within the belt, while both end rollers 92,94 are free-rolling. Preferably, at least one of the end rollers 92,94 is attached to a horizontal spring, such as spring 99 shown for end roller 92 in FIG. 7, such that it is movable to release the belt 90 for removing and replacing the belt 90. End roller 92 is mounted to slide towards and away from end roller 94, and spring 99 resiliently biases end roller 92 away from end roller 94. Thus, when the belt 90 is to be removed or replaced from the end rollers, end roller 92 can be pushed toward end roller 94 to facilitate the removal or replacement by decreasing the spacing between the end rollers 92,94 to release the belt.

Figure 10:
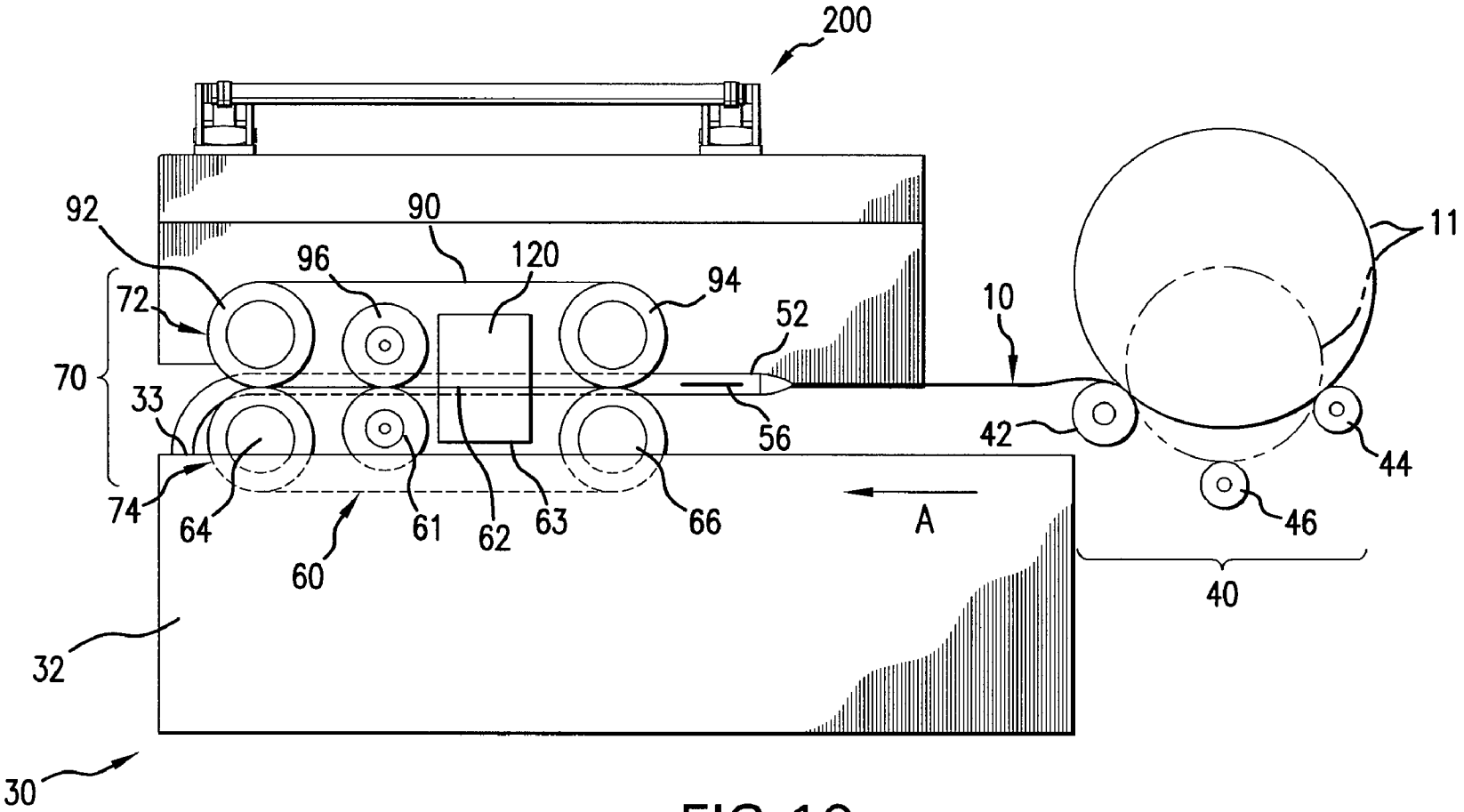
FIG. 10 is a side view of an embodiment of the device.

In a preferred embodiment, the end rollers 92,94 are not directly driven to move the film 10, but the device 30 includes a separate roller, such as pressure roller 96, that is associated with a driving mechanism to continuously drive the film 10. The driving mechanism preferably includes motor 116 that drives roller 96 through a transmission 110, which preferably includes a series of gears, although other driving mechanisms can be used. As shown in FIGS. 4 and 10, the pressure roller 96 is positionable to hold or press the belt 90 against the platform 80 or belt 60 to drive the belt 90 in the direction A, and thus provides additional pressure on the film 10 against the platform 80 or belt 60. The pressure roller 96 is preferably attached to a vertical spring 98 to bias it against the belt 90. In other embodiments, one or both end rollers 92,94 can additionally or alternatively be driven by a single drive mechanism or separate drive mechanisms. For example, one of the end rollers 92,94 can be directly driven by a gear and motor system, while power is transferred to the other end roller by another gear system. Such embodiments can also optionally include a pressure roller to provide additional pressure on the film.

In an embodiment, each of the first and second end rollers 92,94 preferably includes raised sidewalls 131,133 that define a belt groove 135,137 therebetween. The raised sidewalls 131, 133 advantageously help maintain the belt 90 in the belt groove 135,137 and in association with the end rollers 92,94, even when the belt is driven at high rotational speeds.

The length, width, and thickness of the belt 90 can be selected and adjusted as desired, depending on, for example, the film material, the desired sealing configuration, and the size of the film and the sealing, to provide optimal film-holding, heating, and sealing. The length 100 of the belt 90, i.e., the end-to-end distance between the end rollers 92,94, is selected or adjusted to provide sufficient space to include the end rollers 92,94, pressure roll 96, and heating element 120. In an embodiment, the length 100 is at least about 5 inches. The length 100 is at most about 50 inches, preferably at most about 30 inches, and more preferably at most about 20 inches. In a preferred example, the length 100 is between about 5 and 10 inches. In one embodiment, the width 102 of the belt 90 is at least about 0.25 inches and at most about 2 inches, and more preferably is about 0.5 to 1.5 inches, but the belt can have other widths in other embodiments. In an embodiment, the belt 90 has a thickness of at least about 0.02 inches, more preferably at least about 0.05 inches, and even more preferably at least about 0.07 inches, but can have other thicknesses in other embodiments. The belt thickness preferably provide advantages such as maintaining a sufficient stiffness of the belt to ensure hold-back and containment of the air within the inflated cushion cavities, allowing the belt to properly track on the end rollers, and minimizing the effect of the belt on the drive pitch diameter.

The belt 90 is made of a heat-resistant, heat-transferring material, so that it preferably efficiently transfers the heat from the heating element to the film 10 to melt and seal the film 10, but can withstand continuous operating temperatures of at least about 200° F. due to its proximity to the heating element of the sealing assembly. The belt 90 is also preferably made of durable, low-wear material to promote extended life of the belt. In an example, the belt 90 is configured to last at least about 50 hours, and preferably at least about 100 hours of operation before replacement, based on the desired operation of the device. The heat-resistant characteristics of the belt material also advantageously extend the life of the belt, despite the increased temperatures applied to the belt during film sealing operations, and/or the heat friction that results from the contact with the film material. In an embodiment, the belt 90 comprises a fluorocarbon, such as tetrafluoroethylene, or a silicon composite, or has a fluorocarbon- or silicon-laminated surface. In an example, the belt 90 is made of or covered with TEFLON®, manufactured by DuPont, or has a TEFLON® or silicon-laminated surface. An example of a silicon-containing surface material is SILAM K® silicone surface, sold by Ammeraal Beltech, Inc.

The support surface can be stationary, such as a platform 80 as shown in FIGS. 3-4, or movable, such as a belt 60 as shown in FIG. 10. The support surface 75 can have any suitable shape to provide contact between the film 10, belt 90, and platform 80 or belt 60. The platform 80 and belt 60 of the embodiments shown have planar top surfaces 82,62 on which the film 10 slides along as it is sealed. The support surface 75 helps flatten the film as it is sealed, and therefore helps deflect imperfections in the film.

When platform 80 is used as a stationary support surface 75, the top surface 82 is preferably at least about 4 inches and at most about 15 inches long, more preferably at least about 5 inches and at most about 10 inches long, and still more preferably between about 5 and 9 inches long. In the embodiment shown in FIG. 3, the belt 90 is slightly longer than the platform 80. The length of the top surface 82 is preferably close to the distance between the bottom of the end rollers 92,94. The width of the top surface 82 also preferably substantially corresponds to that of the belt 90. In an embodiment, the width is at least about 0.25 inches and at most about 2 inches, and more preferably is about 0.5 to 1.5 inches. The platform 80 can have any desired height, for example, about 1 to 10 inches, more preferably about 2 to 5 inches.

The platform 80 preferably includes a material selected so that its top surface 82 provides suitable heat-resistant characteristics for sealing the film 10. In an embodiment, the platform 80 is provided as a heat-resistant rubber pad that is capable of withstanding the heat transferred to the platform 80 during the sealing process. The heat-resistant rubber is preferably capable of withstanding temperatures of at least about 100° F., and preferably at least about 120° F. The heat-resistant rubber can be provided on the entire platform 80, or partially, such as on the top portion of the platform 80. In a further embodiment, the platform 80 comprises a heat-resistant rubber and further includes a material with even greater heat-resistant characteristics, such as a fluorocarbon (e.g., TEFLON®), a silicon composite, or a TEFLON® or silicon-laminated material, on at least a portion of the top surface 82. Preferably, the platform includes such material over substantially the entire area of the top surface 82 underneath the heating element 120. In a further embodiment, substantially the entire top surface 82 is covered with such material. In an example, the platform 80 comprises a heat-resistant rubber pad or block including a TEFLON® cover layer, such as a piece of TEFLON® tape, film or coating, on the top surface 82.

Alternatively, the support surface 75 can be provided in the form of the belt 60, as shown in FIG. 10. The belt 60 is looped around belt supports such as end rollers 64,66. Similar to the end rollers 92,94 of the belt 90, the end rollers 64,66 preferably include raised sidewalls 164,166 that define a belt groove 163,165 therebetween, to help maintain the belt 60 in the belt groove 163,165 and in association with the end rollers 64,66, even when the belt is driven at high rotational speeds. At least one of the end rollers 64,66 can be movable to release the belt 60 for removing and replacing the belt 60. For example, one of the end rollers 64,66 can be resiliently biased against the other by a spring. A pressure roller 61 and a support block 63 are provided below the pressure roller 96 and the sealing surface 122, respectively, to support the film 10 against the pressures of the pressure roller 96 and sealing surface 122, and to cooperatively hold the film 10 therebetween. The pressure roller 61 and the support block 63 can have substantially the same dimensions as the pressure roller 96 and the sealing surface 122.

The end rollers 64,66 can be free-rolling or can be driven, such as by a motor and gear system. The belt 60 can be configured to move at the same speed as or at a different speed from the belt 90. In an embodiment, one motor and gear system can be used to drive both the belt 60 and belt 90. For example, the motor and gear system can include a transmission with a series of transmission members, such as gears, one of which is associated with the belt 60 and another of which is associated with the belt 90, such that the belts 60,90 can be driven simultaneously. In another embodiment, separate motor and gear systems can be provided for belt 60 and belt 90.

The dimensions of the belt 60 are preferably similar to those of the belt 90 of the first portion 72, although, in other embodiments, the dimensions can be selected and adjusted as desired. In an embodiment, the belt 60 has a length 61, i.e., the end-to-end distance between the end rollers 64,66, of at least about 5 inches. The length 61 is at most about 50 inches, preferably at most about 30 inches, and more preferably at most about 20 inches. Preferably, the length 61 is between about 5 and 10 inches. The width 63 of the belt 60 is preferably at least about 0.25 inches and at most about 2 inches, and more preferably is about 0.5 to 1.5 inches. In an embodiment, the belt 60 has a thickness of at least about 0.02 inches, more preferably at least about 0.05 inches, and even more preferably at least about 0.07 inches.

The belt 60 preferably includes a material selected so that its top surface 62 provides suitable heat-resistant characteristics for sealing the film 10. The belt 60 is also preferably made of durable, low-wear material to promote extended life of the belt. In an example, the belt 90 is configured to last at least about 50 hours, and preferably at least about 100 hours of operation before replacement, based on the desired operation of the device. The heat-resistant characteristics of the belt material also advantageously extend the life of the belt, despite the increased temperatures applied to the belt during film sealing operations, and/or the heat friction that results from the contact with the film material. In an embodiment, the belt 60 comprises a fluorocarbon, such as tetrafluoroethylene, or a silicon composite, or has a fluorocarbon- or silicon-laminated surface. In an example, the belt 60 is made of or covered with TEFLON® or has a TEFLON® or silicon-laminated surface, e.g., SILAM K® silicone surface. In preferred embodiments, the belt 60 is made of the same material as the belt 90.

A cover can be provided partially or entirely over the space defined by the end rollers 64,66. A similar cover can be provided over the belt 90 of the first portion 72. The cover can extend substantially the entire length and height of the belt 60 and/or belt 90, or can be provided over only a portion of the belt 60 and/or belt 90. The cover on the belt 60 can extend to the tabletop 33 of the housing 32. The cover can have any suitable configuration. For example, the cover can have a substantially rectangular shape or can have rounded end portions to conform to the general contour of the belt. The cover can also have a dumbbell shape with generally round end portions and narrower linear center portion therebetween. The cover can also include any desired patterns, such as holes.

As the film 10 moves in the downstream direction A, the belt 90 and the support surface 75 cooperatively apply pressure and hold the film layers 20,22 against each other along the sealing portion 8 sufficiently tightly to prevent air within the inflated cushion cavities from leaking during the rest of the sealing process. To provide a maximum pinching pressure between the belt 90, support surface 75, and the film layers 20,22, the spacing between the belt 90 and the support surface 75 is preferably minimized. Preferably, the belt 90 and the support surface 75 contact each other.

Figure 6:
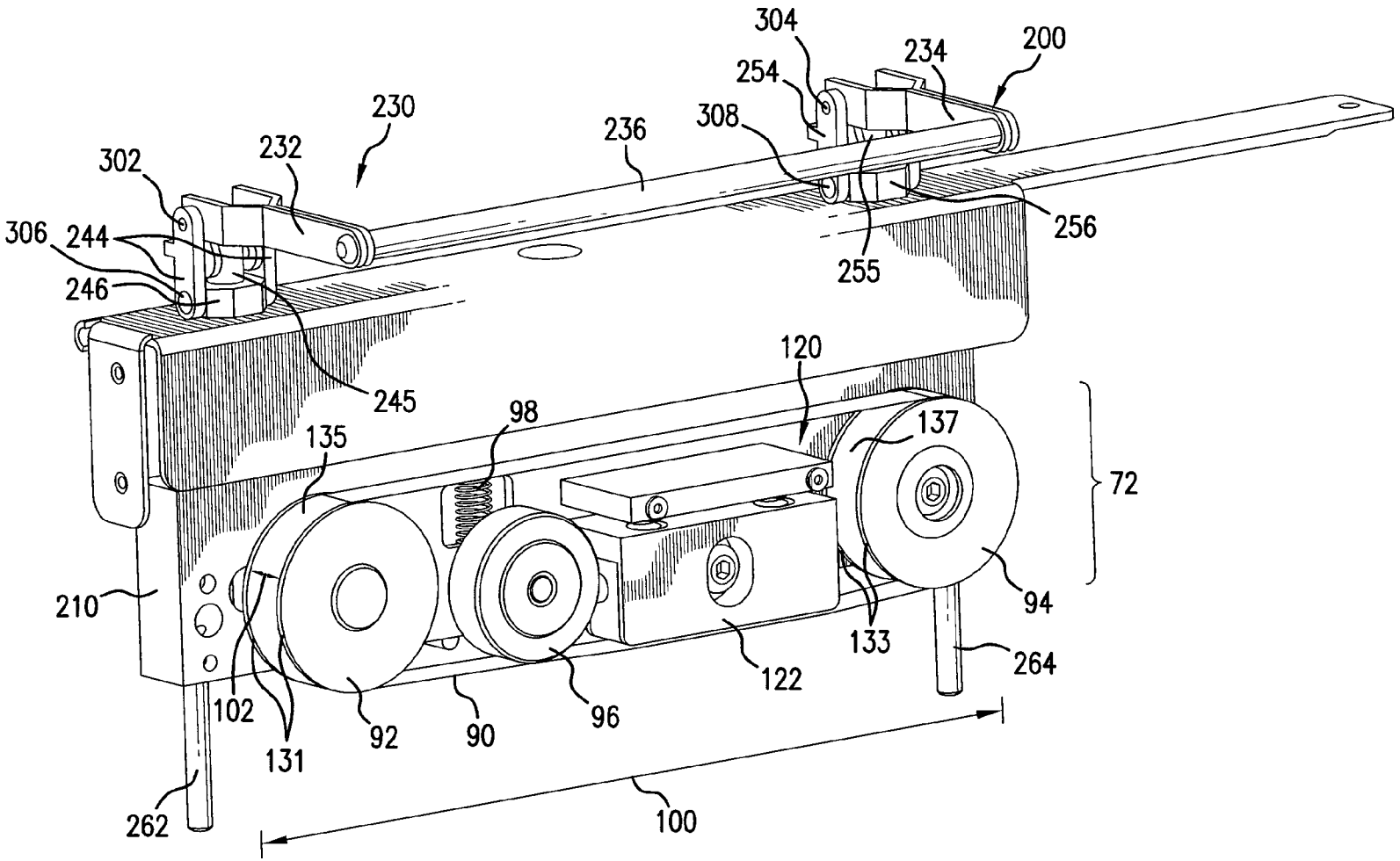
FIGS. 6 and 7 are front perspective and rear views, respectively, of a portion of the sealing assembly and disengagement mechanism thereof in an engaged position.

After being pressed between the belt 90 and support surface 75 and being cut, the film 10 is directed to the heating element 120, which is positioned over a portion of the belt 90. Although the heating element 120 is included in the first assembly portion 72 in preferred embodiments, additional heating elements can be included in the second assembly portion 74, for example positioned over a portion of the belt 60. As shown in FIG. 6, the heating element 120 has a sealing surface 122 that preferably corresponds to the slope of the support surface 75 and in the preferred embodiment is preferably planar. The sealing surface 122 is also preferably substantially smooth and continuous to produce a uniform seal with no gaps or pockets that would allow air to escape from the cushion cavities. The sealing surface 122 is configured and positioned to directly contact the belt 90 and to press it down against the film 10 placed therebelow. The heat transferred to the film 10 through the belt 90 is sufficient to melt or otherwise close and seal the film 10.

Preferably, the sealing surface 122 has substantially the same or smaller width than the belt 90, such that the surface 122 contacts only the belt 90 and does not directly contact the film 10. In an example, the sealing surface 122 has a width of at least about 1/10 inch and at most about 1 inch, more preferably at least about 1/4 inch and at most about 3/4 inch. In an example, the width of the sealing surface 122 is about 1/2 inch. The sealing surface 122 has a length of at least 1 inch and at most about 3 inches, preferably at least about 1.5 inches and at most about 2 inches. In an embodiment, the length is about 2 inches.

The heating element 120 includes or is connected to a heat source to provide sufficient heat on the sealing surface 122, such that the heat transmitted through the belt 90 to the film 10 is sufficient to melt or otherwise close and seal the film 10. The sealing surface 122 is heated to a sealing temperature that is at least the melting point of the film 10, and preferably at least about 10° F. greater than the melting point of the film. For example, where the film 10 comprises polyethylene having a melting point of about 180° F. and 200° F., the sealing surface 122 is heated to at least about 200° F., and more preferably at least about 210° F. The sealing temperature should also be such that, when the film 10 is placed under the sealing surface 122, the film 10 melts and sticks to the portion of the belt 90 underneath the sealing surface 122, and skids in the direction A as the belt is moved in that direction.

The sealing surface 122 is preferably maintained at a consistent sealing temperature so that heat is properly transferred through the belt 90 onto the film 10 to reliably weld the layers 20,22. Preferably, the sealing surface 122 is continuously heated to produce a continuous seal with no unsealed parts or gaps that would allow air to escape from the cushion cavities.

The heating parameters, including the sealing temperature and the length of time the sealing surface 122 contacts the film 10, can be adjusted to achieve optimal sealing results. The sealing temperature can also be adjusted based on other operation parameters such as the operation speed, the material properties of the film 10, the condition and material properties of the belt 90, and other operating conditions.

The length of sealing time, i.e., the time the sealing surface 122 contacts the film 10, also can be adjusted depending on the types of the film and belt materials and other operating conditions, by adjusting the speed of the operation. For example, where a pressure roller 96 is provided to drive the belt 90, sealing time can be adjusted by changing the rotation speed of the pressure roller 96. In an embodiment, the device 30 is operated such that the film 10 is propagated through the device at a speed of at least about 10 ft/min, preferably at least about 15 ft/min, and more preferably at about 20 to 30 ft/min, but other speeds can be used as desired.

The heating element 120 can provide heating in any suitable manner. In an embodiment, the heating element 120 includes heating wires, such as wires made of nickel-chromium alloy, e.g., about 80% nickel and about 20% chromium. In another embodiment, the heating element 120 is a custom "thin film" heater, such as one produced by Minco Corp. Such heater uses thin, resistance alloy etching that is bonded to, for example, KAPTON® sold by DuPont, and attached to aluminum foil. This technology also allows an integrated thermocouple to provide temperature feedback to a programmable logic controller. In another embodiment, the heating element 120 includes traditional resistance heaters, such as FIREROD® cartridge heaters, for example as sold by Watlow Electric Manufacturing Co.; flexible, silicon rubber-based heaters; or the like. Such heaters, however, may be relatively slow to achieve desired heating. The device 30 can include a temperature control or sensor, e.g., a thermocouple feedback, an infrared non-contact temperature sensor, or a current detecting sensor, to monitor and maintain the heating element 120 and/or sealing surface 122 at an optimal sealing temperature. Such temperature control or sensor can be set up to provide feedback to a programmable logic controller to monitor the real-time temperature of the heating element 120 and/or sealing surface 122.

Advantageously, as the sealed film 10 is directed away from the sealing surface 122, the sealed film starts to cool but remains sufficiently hot to ensures proper formation of the seal with an appropriate and desired seal integrity, even at increased inflation pressures as high as about 5 psi to about 15 psi or greater, upon exiting the sealing assembly 70. The sealed film can cool in ambient temperatures, or a cooling device, such as a fan or blower, can be used to accelerate the cooling, such as by directing cool air to the film.

Figure 5:
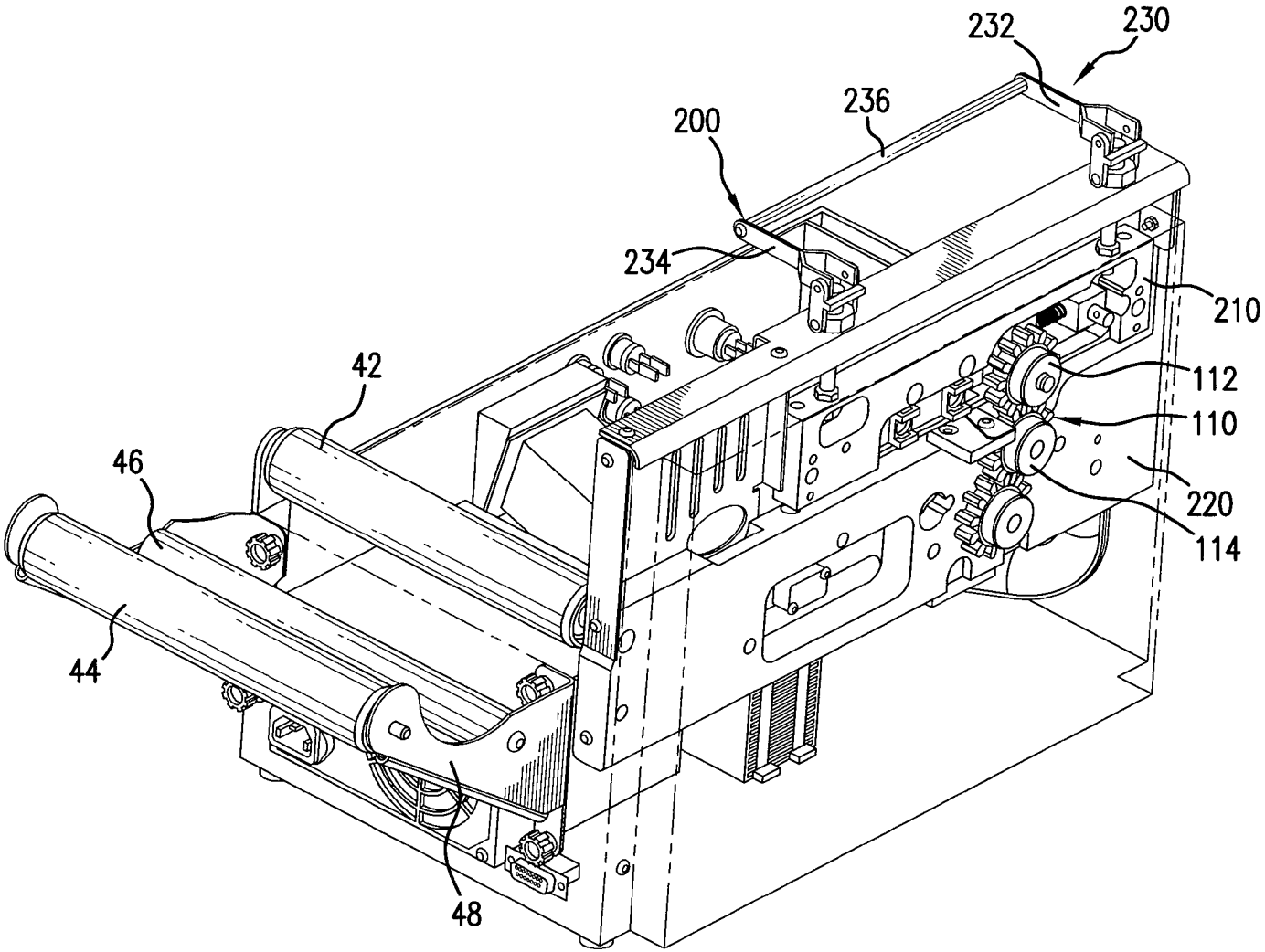
Figure 7:
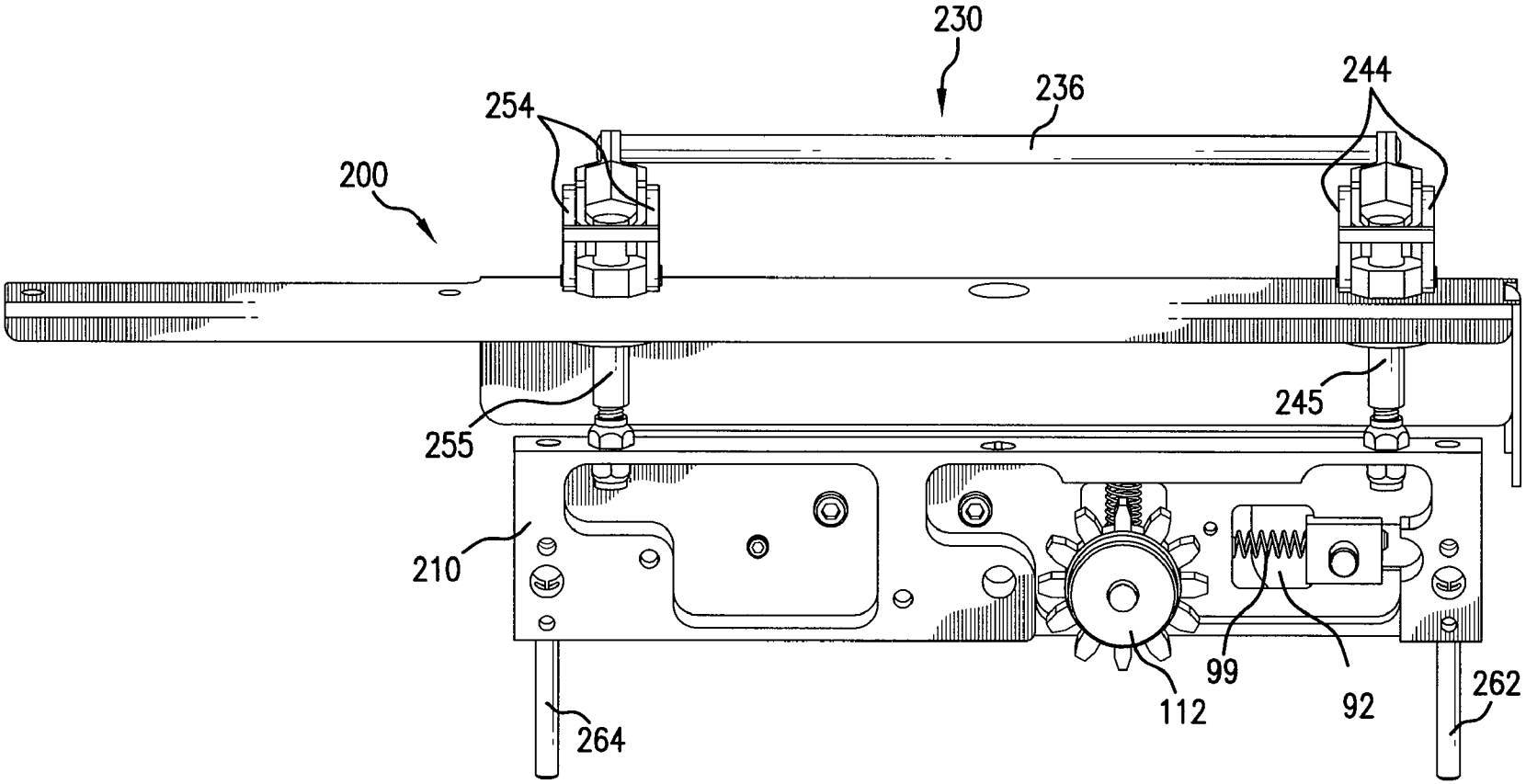

In a preferred embodiment, the device 30 includes a disengagement mechanism 200 so that first portion 72 and second portion 74 of the sealing assembly 70 are reversibly disengageable from each other for releasing pressure therebetween and for releasing the overlapping portions of the film 10 therefrom. Referring to FIGS. 3 and 5, the device 30 includes first and second engaging units 210,220 that are respectively attached to the first and second portions 72,74 of the sealing assembly 70. The first and second engaging units 210,220 are movable relative to each other, such as vertically or horizontally depending on the orientation of the device, to separate from each other to release the pressure therebetween. For example, the first engaging unit 210 can be mounted on alignment shafts 262,264 and disengagement shafts 245,255, as shown in FIGS. 6 and 7, such that it is vertically movable with respect to the second engaging unit 220 by sliding along the alignment shafts 262,264. The second engaging unit 220 is fixed with respect to the inflation assembly. Alternatively or additionally, the first engaging unit 210 can be configured for horizontal movement relative to the second engaging unit 220, or the second engaging unit can be configured for horizontal and/or vertical movement relative to the first engaging unit 210. The disengagement mechanism 200 can be operated by hand, e.g., released and moved away by hand, or be motor-driven. Preferably, the disengagement mechanism 200 and disengaged portion of the device 30 are not completely disassociated from the device 30 in the disengaged position, but stay attached to at least a portion of the device 30.

The disengagement mechanism 200 includes an actuation mechanism, such as a lever member 230, that is connected to a top portion of the first unit 210. By operating the lever member 230, the user can move the unit 210 vertically, along the alignment shafts 262,264, thus moving the first portion 72 of the sealing assembly 70 to engaged and disengaged positions.

In an embodiment, the lever member 230 includes a four-bar linkage that is positioned in an over-center position in the engaged position to stably remain in the engaged position. Referring to FIGS. 3, 6, and 7, the lever member 230 is shown in the engaged position, in which the first portion 72 of the sealing assembly is placed proximate the second portion 74 for sealing the film 10. For purposes of illustration, the second portion 74 of the sealing assembly 70 is not shown in FIGS. 6 and 7.

The lever member 230 of the preferred embodiment includes a pair of levers 232,234. The levers 232,234 are connected by a handle 236 at one end. The handle 236 is pivotably associated with the disengagement mechanism 200 for pivoting about an axis that is preferably generally aligned with the sealing direction. The opposite end of each lever 232,234 is pivotally engaged to a pair of links 244,254 by pins 302,304. The links 244,254 are also pivotally engaged to linkage base members 246,256 that are connected to the first portion 72 by pins 306,308. The bars including the levers 232,234 are bent, preferably near or about pins 302,304 to provide an angle, preferably about a right angle, between the levers 232,234 and legs 233,235. The legs 233,235 are each pivotally engaged to shafts 245,255 by a pair of pins 310,312. (Only one pin of each pair of pins shown in FIGS. 6-8 for clarity). The shafts 245,255 are connected to the first engaging unit 210, and slide linearly to move the first engaging unit 210 away and towards the second engaging unit 220, such as in a direction along a substantially vertical plane, and preferably vertically. The preferred disengagement mechanism 200 includes parallel four-bar linkages formed by the legs 233, 235, links 244,254, shafts 245,255, and bases 246,256.

Preferably, the disengagement mechanism 200 is configured to remain stably in an engaged position in which the first and second portions 72,74 apply pressure against each other. In the engaged position shown in FIGS. 3, 6 and 7, the lever member 230 form a plane that is parallel to the major plane of the film 10, and the handle 236. The links 244,254 are positioned vertically, transverse to the levers 232,234, and the shafts 245,255 are in a lowered position. The handle 236 can extend over the first portion 72, with its initial movement from the engaged position, and its final movement towards the engaged position, being in generally the same direction as the movement of the first engagement unit 210. In an alternative embodiment, however, the engaging mechanism can move the second engagement unit in addition to or instead of the first engagement unit.

Figure 8:
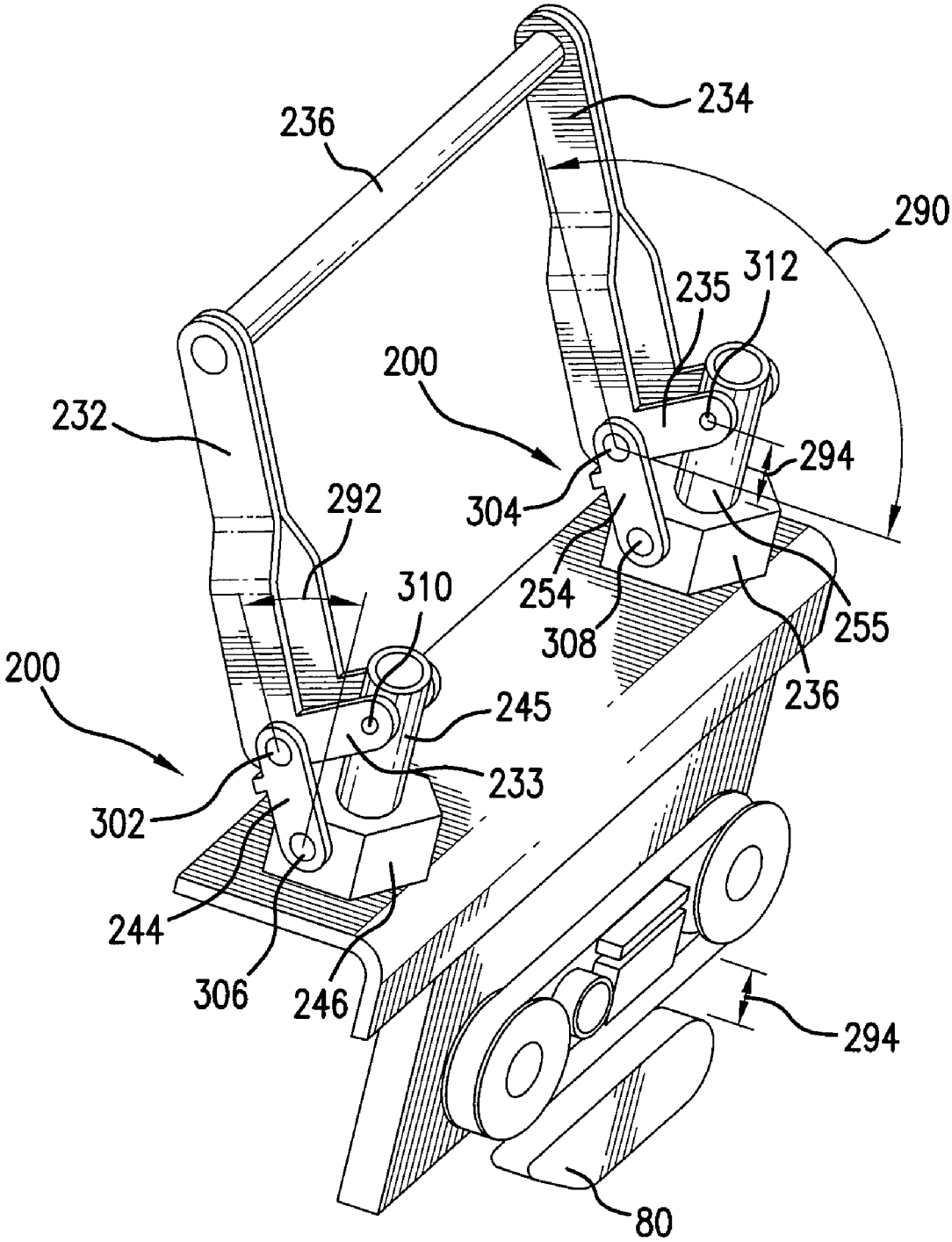
FIG. 8 is an illustration of the disengagement mechanism and lower sealing assembly portion of the preferred embodiment in an disengaged position.

To disengage the first portion 72 from the second portion 74 of the sealing assembly 70, the lever member 230 is pivoted by rotating the handle 236 upward, to a predetermined angle 290 from the engaged position, as shown in FIG. 8. The links 254,255 also pivot correspondingly, by an angle 292, thus pivoting the legs 233,235 and lifting the shafts 245,255 by a distance 294. The first engaging unit 210 is lifted by the same distance, thus disengaging the first portion 72 from the second portion 74. The second portion 74 is fixed to a base that is attached to the housing 32. The disengaged second portion 74 does not completely come off from the device 30, but stay attached to the device 30 at two points, i.e., the alignment shafts 262,264. In this disengaged position, shown in FIG. 8, the lever member 230 is over the sealing mechanism, and forms a plane that is orthogonal to the major plane of the film 10 through the sealing assembly 70.

In the embodiment shown in FIGS. 5 and 7, the first portion 72 includes the gear 112 connected to the pressure roller 96, such that the gear 112 would also be disengaged from the gear 114 when the first portion 72 is disengaged. As such, the belt 90 and gear 112 separate from the motor 116 in the disengaged position. In one embodiment, the rotational movement of handle 236 causes the linear movement of the end rollers 92,94, preferably in parallel with each other.

To reengage, the lever member 230 is pulled back to the engaged position, and the legs 233,235 push the shafts 245, 255 down against the action of the links 244,254.

While the illustrated disengagement mechanism 200 is operatively connected to the first portion 72 of the sealing assembly 70, it will be appreciated that other types and configurations of disengagement mechanisms can be used, as long as it allows moving the first and second portions of the sealing assembly relative to each other. For example, the disengagement mechanism can be connected to the second portion, such that the second portion is movable from the first portion by being, for example, lowered in height or moved sideways.

The disengagement mechanism advantageously allows the user to more easily access the sealing assembly for repair and maintenance and to release the film therefrom. For example, when the belt 90 and the support surface 75 needs to be cleaned or replaced, and to clear jams and to load initially, the user can access them by simply lifting the lever to disengage the belt from the support surface. The disengagement mechanism also allows the inflation and sealing operation to be stopped without requiring the heating element to be turned off or the film to be removed from the sealing assembly to avoid damage from prolonged exposure to heat. Thus, when the operation is temporarily halted, the sealing surface can remain continuously powered or can be maintained at high temperatures and does not need to be cooled and reheated, such that the operation can resume immediately as desired.

To operate the device 30, the lead end of the film 10 is pulled from the supply roll 11 and directed to the inflation assembly 50. The inflation channel 23 is fed over the nozzle 52 of the inflation assembly 70 through the lead opening 24. The lead end of the film 10 is then manually directed between the belt 90 and the support surface 75 of the sealing assembly 70, where the sealing portion 8 of the film is pinched between the pressure roller 96 and the support surface 75. Once the gear and motor system associated with the pressure roller 96 is initiated and the sealing surface 122 is heated, for example by turning on a power source of the device 30, the remainder of the manufacturing process is automated, as the film 10 is continuously pulled from the supply roll 11 and directed to the nozzle 52 for inflation, blade 76 for cutting, and heating element 120 for sealing.

In addition to the mechanisms described herein, it will be appreciated that the device 30 can include various supplementary mechanisms and control functions. For example, the device 30 can include a central controller, a monitor, control signals, and feedback systems. Further, the device 30 advantageously requires only standard power utility requirements, such as by being capable of plugging into a standard wall outlet of 120 or 240 VAC, and 15 amp, and therefore can be operated with a simple on-off switch.

The device thus improves and simplifies inflation and sealing process by providing relatively simple control and operation, and allowing the use of a variety of film materials. The device also provides for easy replacement of its various parts, for example, by providing a disengagement mechanism that facilitates disengagement of certain parts of the device.

All of the references specifically identified in the detailed description section of the present application are expressly incorporated herein in their entirety by reference thereto. The term "about," as used herein, should generally be understood to refer to both the corresponding number and a range of numbers. Moreover, all numerical ranges herein should be understood to include each whole integer within the range.

While illustrative embodiments of the invention are disclosed herein, it will be appreciated that numerous modifications and other embodiments may be devised by those skilled in the art. For example, the features for the various embodiments can be used in other embodiments. Therefore, it will be understood that the appended claims are intended to cover all such modifications and embodiments that come within the spirit and scope of the present invention.

What is claimed is:

1. An inflatable-cushion inflation and sealing device, comprising:

an inflation assembly configured for inflating with a fluid a cushion cavity disposed between first and second layers of a film;

a sealing assembly comprising first and second assembly portions configured for receiving overlapping portions of the first and second film layers adjacent the inflated cavity and for cooperatively driving the overlapping portions along a sealing direction and for applying sufficient pressure to the overlapping portions to substantially keep the fluid from escaping from between the overlapping portions and to seal the overlapping portions to each other and to form a longitudinal seal configured to seal the fluid in the cushion cavity;

a disengagement mechanism associated with the first and second assembly portions for moving the first assembly portion relative to the second assembly portion for reversibly disengaging the first and second assembly portions for releasing the pressure therebetween; and a handle mounted pivotally with respect to at least one of the assembly portions and operably associated with the disengagement mechanism for engaging the assembly portions when in an engaged position, and disengaging the assembly portions when in a disengaged position, wherein the handle extends over the first portion in the engaged position.

2. The device of claim 1, wherein the handle is pivoted away from the second assembly portion in the disengaged position.

3. The device of claim 1, wherein the handle is pivotably associated with the disengagement mechanism for pivoting about an axis that is generally aligned with the sealing direction.

4. The device of claim 1, wherein the disengagement mechanism is configured to remain stably in an engaged position in which the first and second portions apply pressure against each other.

5. The device of claim 4, wherein the disengagement mechanism comprises a four-bar linkage, which includes the handle, which handle is rotatable to move the first or second portion and that has an over center position to stably remain in the engaged position.

6. The device of claim 5, wherein the first assembly portion is mounted on at least one shaft that slides with respect to the second assembly portion such that the first assembly portion is separated from the second assembly portion when the four-bar linkage is operated to disengage the assembly portions.

7. The device of claim 1, wherein the disengagement mechanism is configured for separating the first and second assembly portions to release the overlapping portions from therebetween.

8. The device of claim 1, further comprising a base, to which the second assembly portion is fixed with respect to the inflation assembly.

9. The device of claim 1, wherein:

the first assembly portion includes a belt support and a belt supported and driven therearound for driving the overlapping portions in the sealing direction; and the second portion includes a support surface facing the belt for receiving the overlapping surfaces therebetween adjacent the inflated cavity;

wherein the belt is configured to move at a different speed than the support surface to cause the overlapping portions to slide against the support surface while driving the overlapping portions along a sealing direction.

10. The device of claim 9, wherein:

the belt support comprises a plurality of rollers; and the second assembly portion comprises a stationary support surface facing the belt.

11. The device of claim 1, wherein the first assembly portion comprises belt supports and a belt supported and driven therearound for driving the overlapping portions in the sealing direction, at least one of the belt supports being movable to release the belt for removing and replacing the belt thereon.

12. The device of claim 11, wherein the belt supports comprise only two rollers.

13. The device of claim 1, wherein the first assembly portion comprises:

belt supports and a belt supported and driven therearound for driving the overlapping portions in the sealing direction; and a heater associated with the belt for transferring heat through the belt for sealing the overlapping portions.

14. The device of claim 13, wherein the belt and the support surface comprise a heat-resistant material having a melting temperature greater than 200° F.

15. The device of claim 1, wherein:

the first assembly portion comprises belt supports and a belt supported and driven therearound for driving the overlapping portions in the sealing direction; and the device further comprising a motor configured for driving the belt to drive the overlapping portions in the sealing direction;

wherein the disengagement mechanism is configured for disengaging the belt from the motor in the disengaged position.

16. The device of claim 1, wherein the overlapping portions are connected on two sides of an inflation channel that is fluidly communicated with the inflation cavity for the filling thereof, the inflation channel extending generally in the sealing direction, the device further comprising:

a fluid conduit configured for longitudinal reception between the overlapping portions in the inflation channel; and a cutter disposed proximate the fluid conduit and configured and oriented to cut open the inflation channel to provide an exit from the channel for the conduit.

17. The device of claim 1, wherein the sealing assembly is configured to heat the overlapping portions under pressure from the first and second portions for sealing the overlapping portions together.

18. An inflatable-cushion inflation and sealing device, comprising:

an inflation assembly configured for inflating with a fluid a cushion cavity disposed between first and second layers of a film;

a sealing assembly comprising first and second assembly portions configured for receiving overlapping portions of the first and second film layers adjacent the inflated cavity and for cooperatively driving the overlapping portions along a sealing direction and for applying sufficient pressure to the overlapping portions to substantially keep the fluid from escaping from between the overlapping portions and to seal the overlapping portions to each other, thereby forming a longitudinal seal configured to seal the fluid in the cushion cavity; and a disengagement mechanism associated with the first and second assembly portions for linearly moving the first assembly portion relative to the second assembly portion for reversibly disengaging the first and second assembly portions for releasing the pressure therebetween.

19. The device of claim 18, wherein the first assembly portion is mounted on at least one shaft that is slidable with respect to the second assembly portion.

20. The device of claim 19, wherein the disengagement mechanism comprises a four-bar linkage with a handle that is rotatable to move the first or second portion and that has an over center position to stably remain in the engaged position, the shaft being mounted such that the first assembly portion is separated from the second assembly portion when the four-bar linkage is operated to disengage the assembly portions.

21. An inflatable-cushion inflation and sealing device, comprising:

an inflation assembly configured for inflating with a fluid a cushion cavity disposed between first and second layers of a film;

a sealing assembly comprising:

a first assembly portion including a belt support and a belt supported and driven therearound for driving the overlapping portions in the sealing direction, and a second assembly portion including a support surface facing the belt for receiving the overlapping surfaces therebetween adjacent the inflated cavity, the first and second assembly portions associated for cooperatively driving the overlapping portions along a sealing direction and for applying sufficient pressure to the overlapping portions to substantially keep the fluid from escaping from between the overlapping portions and to seal the overlapping portions to each other, thereby forming a longitudinal seal configured to seal the fluid in the cushion cavity;

a motor;

a transmission operably associating the motor with the first assembly portion for driving the belt to drive the overlapping portions along the sealing direction; and a disengagement mechanism operably associated with the first and second assembly portions and transmission for reversibly disengaging first assembly portion from the motor and second portion such that first assembly portion relative to the second assembly portion is moved with respect to the second assembly portion for releasing the pressure therebetween.

22. The device of claim 21, wherein the disengagement mechanism is configured for disengaging the first assembly portion from the motor and second assembly portion upon a single operation of the disengagement mechanism towards a disengaged position.

23. The device of claim 21, wherein the transmission comprises a first transmission member associated with the first assembly portion, and a second transmission member associated with the motor, wherein the disengagement mechanism is configured for disengaging the first and second transmission portions when the first and second assembly portions are disengaged.

24. The device of claim 21, wherein the disengagement mechanism comprises a handle mounted pivotally with respect to at least one of the assembly portions and configured for operating the disengagement mechanism.

25. The device of claim 21, wherein the sealing assembly is configured to heat the overlapping portions under pressure from the first and second portions for sealing the overlapping portions together.

26. The device of claim 25, wherein the first sealing assembly comprises a heater associated with the belt for transferring heat through the belt for sealing the overlapping portions.

27. An inflatable-cushion inflation and sealing device, comprising:

an inflation assembly configured for inflating with a fluid a cushion cavity disposed between first and second layers of a film;

a sealing assembly comprising a first assembly portion disposed on a first engagement unit and a second assembly portion disposed on a second engagement unit, the first and second assembly portions having an engaged association configured for receiving overlapping portions of the first and second film layers adjacent the inflated cavity and for cooperatively driving the overlapping portions along a sealing direction and for applying sufficient pressure to the overlapping portions to substantially keep the fluid from escaping from between the overlapping portions and to seal the overlapping portions to each other and to form a longitudinal seal configured to seal the fluid in the cushion cavity; and a disengagement mechanism associating the first engagement unit to the second engagement unit for movement between the engaged association and a disengaged condition, in which the first engagement unit is disposed away from the second engagement unit but is retained by the disengagement mechanism attached with respect to each second engagement unit, the disengagement mechanism being configured to align the first engagement unit with respect to the second engagement unit during reengagement thereof into the engaged association, whereby the movement of the first engagement unit to the disengaged condition moves the first assembly portion mounted thereto for releasing pressure between the first and second assembly portions.

28. The device of claim 27, wherein the disengagement mechanism comprises a rail aligning the first engagement unit into the engaged association.

29. The device of claim 28, wherein the disengagement mechanism comprises a four-bar linkage with a handle that is rotatable to move the first or second portion and that has an over center position to stably remain in the engaged position.

30. The device of claim 27, wherein the entire first assembly portion is mounted to the first engagement unit, such that the movement between the engaged association and the disengaged condition moves the entire first assemble portion away from the second assembly portion.

31. An inflatable-cushion inflation and sealing device, comprising:

an inflation assembly configured for inflating with a fluid a cushion cavity disposed between first and second layers of a film;

a sealing assembly comprising a first assembly portion including at least one roller disposed on a first engagement unit and a second assembly portion disposed on a second engagement unit, the first and second assembly portions having an engaged association configured for receiving overlapping portions of the first and second film layers adjacent the inflated cavity and for cooperatively driving the overlapping portions along a sealing direction and for applying sufficient pressure to the overlapping portions to substantially keep the fluid from escaping from between the overlapping portions and to seal the overlapping portions to each other and to form a longitudinal seal configured to seal the fluid in the cushion cavity; and a disengagement mechanism associating the first engagement unit to the second engagement unit for movement between the engaged association and a disengaged condition, in which the first engagement unit is disposed away from the second engagement unit but is retained by the disengagement mechanism attached with respect to each other, the disengagement mechanism being configured to align the first engagement unit with respect to the second engagement unit during reengagement thereof into the engaged association, whereby the movement of the first engagement unit to the disengaged condition moves all of the at least one rollers of the first assembly portion mounted thereto for releasing pressure between the first and second assembly portions.

* * * * *